US009101851B2

(12) United States Patent
Habibi

(10) Patent No.: US 9,101,851 B2
(45) Date of Patent: Aug. 11, 2015

(54) TOY CONNECTOR SYSTEM

(76) Inventor: Maryam Habibi, Fremont, CA (US)

( * ) Notice: Subject to any disclaimer, the term of this patent is extended or adjusted under 35 U.S.C. 154(b) by 41 days.

(21) Appl. No.: 13/876,711

(22) PCT Filed: Sep. 26, 2011

(86) PCT No.: PCT/US2011/053301

§ 371 (c)(1),
(2), (4) Date: Mar. 28, 2013

(87) PCT Pub. No.: WO2012/047594

PCT Pub. Date: Apr. 12, 2012

(65) Prior Publication Data

US 2013/0178129 A1 Jul. 11, 2013

Related U.S. Application Data

(60) Provisional application No. 61/387,118, filed on Sep. 28, 2010.

(51) Int. Cl.

| | |
|---|---|
| ***A63H 27/00*** | (2006.01) |
| ***A63H 33/10*** | (2006.01) |
| ***A63H 33/04*** | (2006.01) |
| *A63H 17/00* | (2006.01) |

(52) U.S. Cl.

CPC ..... *A63H 33/10* (2013.01); *A63H 33/04* (2013.01); *A63H 17/002* (2013.01)

(58) Field of Classification Search

CPC ..... A63H 27/00
USPC ..... 446/91
See application file for complete search history.

(56) References Cited

U.S. PATENT DOCUMENTS

| | | | | |
|---|---|---|---|---|
| 1,086,460 | A | | 1/1914 | Michaelis |
| 3,074,203 | A | * | 1/1963 | Paksy ..... 446/120 |
| 3,386,590 | A | * | 6/1968 | Gretz ..... 211/189 |
| 3,469,339 | A | * | 9/1969 | Thomas ..... 446/122 |
| 3,532,369 | A | * | 10/1970 | Reilly ..... 403/176 |
| 3,696,548 | A | * | 10/1972 | Teller ..... 446/91 |
| 3,751,082 | A | * | 8/1973 | Somerville ..... 211/182 |
| 4,582,496 | A | | 4/1986 | Larws |
| 4,744,780 | A | | 5/1988 | Volpe |
| 5,022,885 | A | | 6/1991 | Lyman |
| 5,499,882 | A | * | 3/1996 | Waterhouse ..... 403/171 |
| 5,678,706 | A | * | 10/1997 | Husak et al. ..... 211/189 |
| 5,916,006 | A | | 6/1999 | Ganson |
| 6,422,909 | B2 | | 7/2002 | Clever et al. |
| 6,461,215 | B1 | | 10/2002 | Kunz et al. |
| 6,742,976 | B2 | | 6/2004 | Groll |

(Continued)

FOREIGN PATENT DOCUMENTS

GB 2169982 7/1986

*Primary Examiner* — Michael Dennis
*Assistant Examiner* — Dolores Collins
(74) *Attorney, Agent, or Firm* — Cislo & Thomas, LLP

(57) ABSTRACT

A toy connector system comprising a plurality of connectors 102, elongated connectable members 104, and planar connectable members 105. The connectable members 104, 105 may come in a variety of shapes and configurations. The connectable members 104, 105 comprise an orifice 404, 1510 into which the connector 102 is fitted so that the connectable members 104, 105 may be reversibly connected to each other in a variety of different configurations via the connectors 102 to build a variety of structures. The toy connector system may further comprise end caps 106, wheels 110, bars 114, and other accessory parts.

20 Claims, 23 Drawing Sheets

(56) References Cited

U.S. PATENT DOCUMENTS

| | | | | |
|---|---|---|---|---|
| 7,316,598 | B1 * | 1/2008 | Lock | 446/126 |
| 7,846,002 | B1 * | 12/2010 | Mikesell et al. | 446/91 |
| 2006/0046604 | A1 | 3/2006 | Scarborough | |
| 2006/0084357 | A1 * | 4/2006 | Rosen et al. | 446/91 |
| 2006/0135033 | A1 | 6/2006 | Evans et al. | |
| 2007/0062421 | A1 | 3/2007 | Sherman | |
| 2009/0233516 | A1 | 9/2009 | Monge Rodriguez | |

* cited by examiner

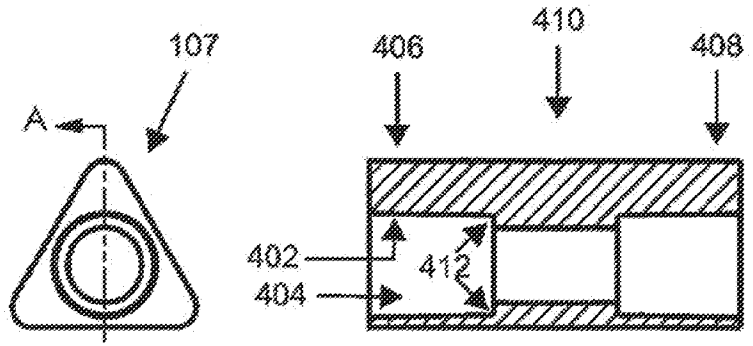
Fig. 13B
Fig. 13C
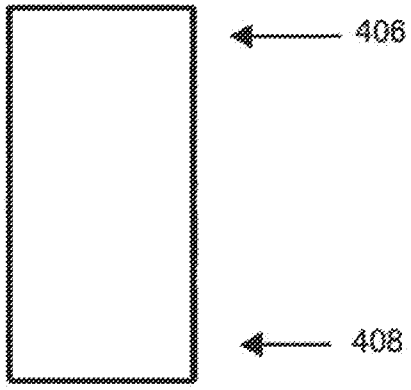
Fig. 13D
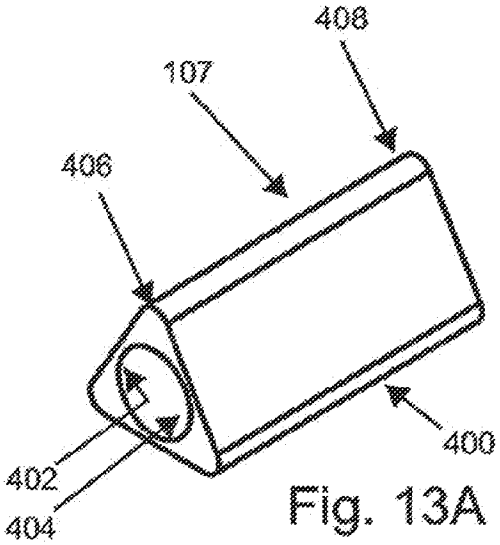
Fig. 13A

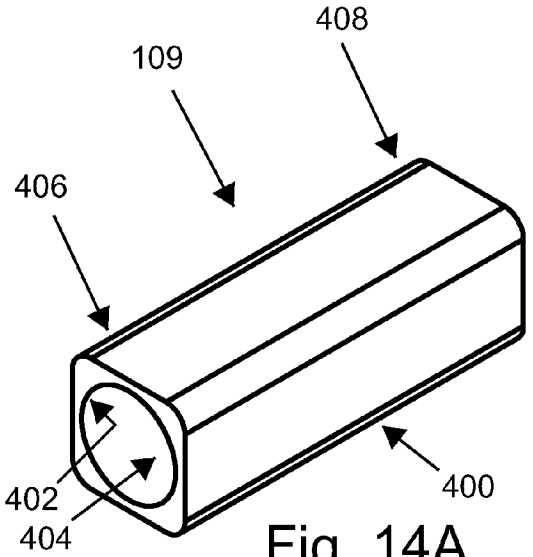
Fig. 14A
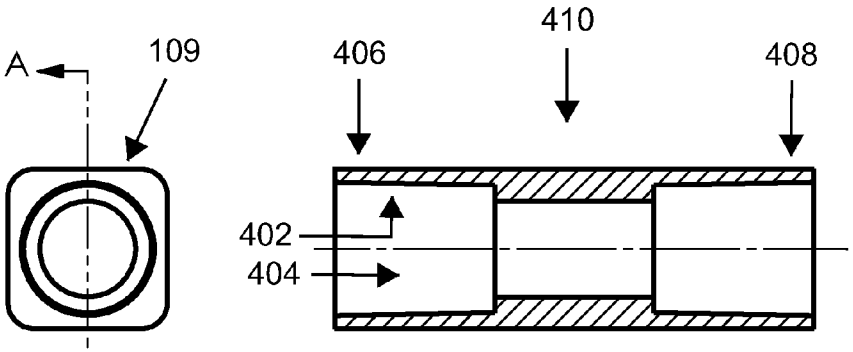
Fig. 14B
Fig. 14C
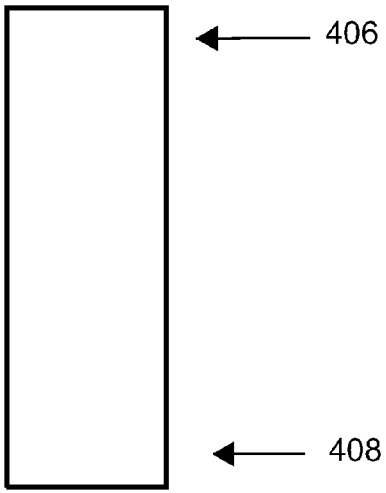
Fig. 14D

TOY CONNECTOR SYSTEM

BACKGROUND OF THE INVENTION

1. Technical Field

This invention relates to toy connector systems.

2. Background Art

TINKERTOYS®, LEGOS®, and other toy building block sets remain popular among young children and parents, not only for their entertainment value, but also for the educational and creative influence. Construction toys have become more and more elaborate with many intricate pieces. However, these building sets are still lacking in the capabilities of creating smooth, flat surfaces that maintain the capability of being built upon in a variety of directions. Therefore, there is still a need for a building system with improved versatility to create a multitude of structures.

BRIEF DESCRIPTION OF THE DRAWINGS

FIG. 13A is a perspective view of another embodiment of a connectable member;

FIG. 13B is a front view of the connectable member shown in FIG. 13A;

FIG. 13C is cross-sectional side view taken along A-A in FIG. 13B;

FIG. 13D is a side view of the connectable member shown in FIG. 13A;

FIG. 14A is a perspective view of another embodiment of a connectable member;

FIG. 14B is a front view of the connectable member shown in FIG. 14A;

FIG. 14C is cross-sectional side view taken along A-A in FIG. 14B;

FIG. 14D is a side view of the connectable member shown in FIG. 14A;

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
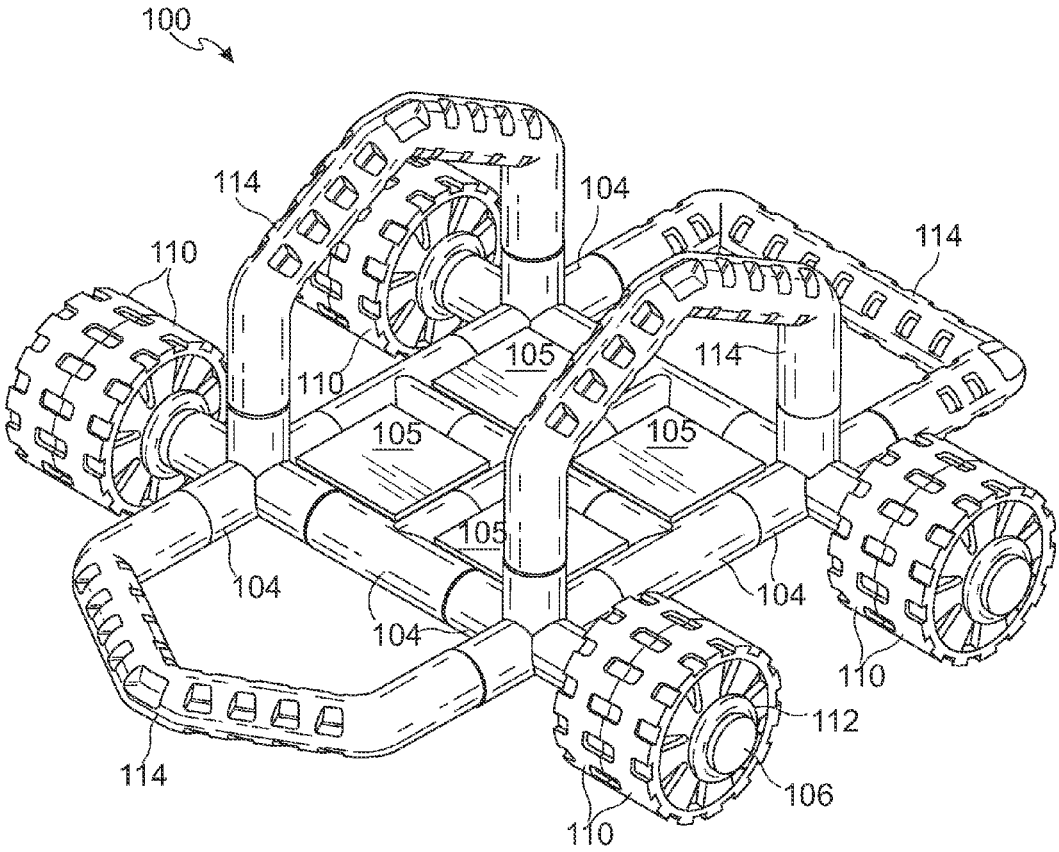
FIG. 1 is a perspective view of an assembled embodiment of the present invention.
Figure 2:
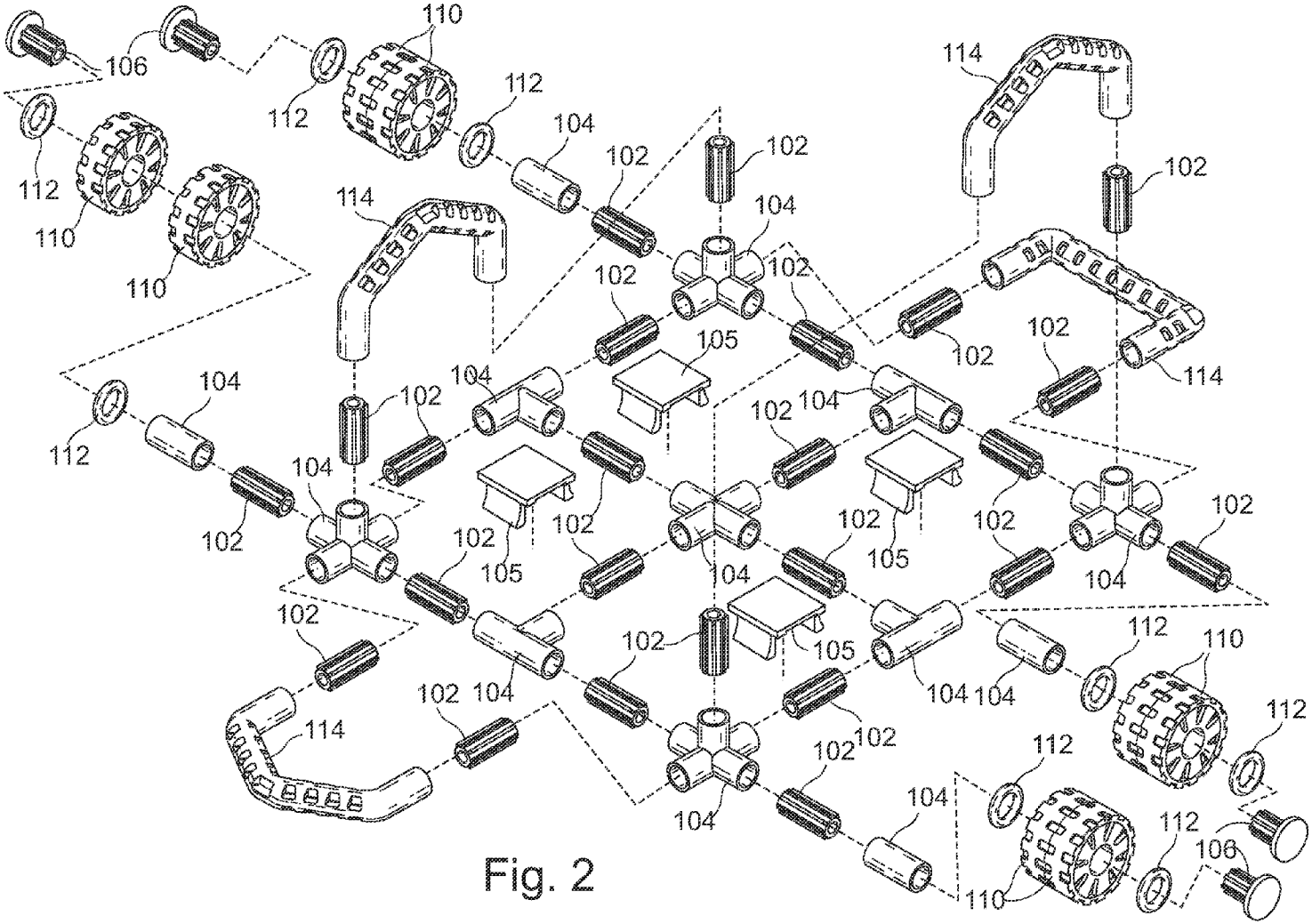
FIG. 2 is an exploded view of the embodiment shown in FIG. 1.

As shown in FIGS. 1 and 2, the toy connector system 100 comprises a plurality of connectors 102 and connectable members 104, 105. The connectable members 104, 105 can be connected to each other via the connectors 102 to build a structure. The connectable members 104, 105 may be reversibly connected to each other in a variety of different configurations via the connectors 102 to build a variety of structures.

Figure 3C:
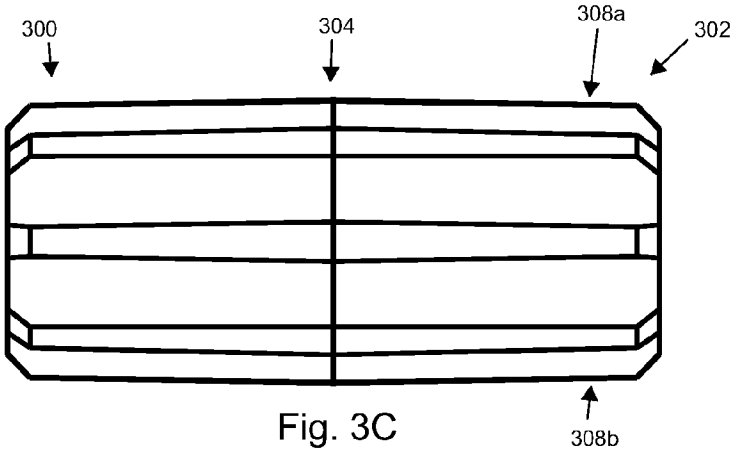
FIG. 3C is a side view of the connector shown in FIG. 3A.
Figure 3B:
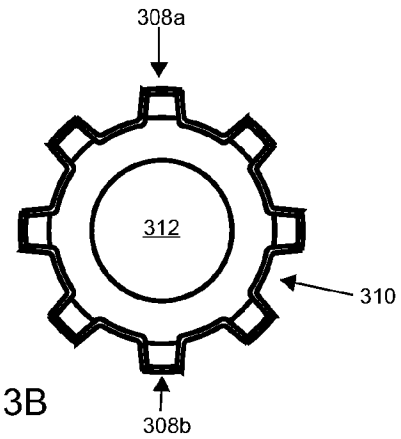
FIG. 3B is a front view of the connector shown in FIG. 3A.
Figure 3A:
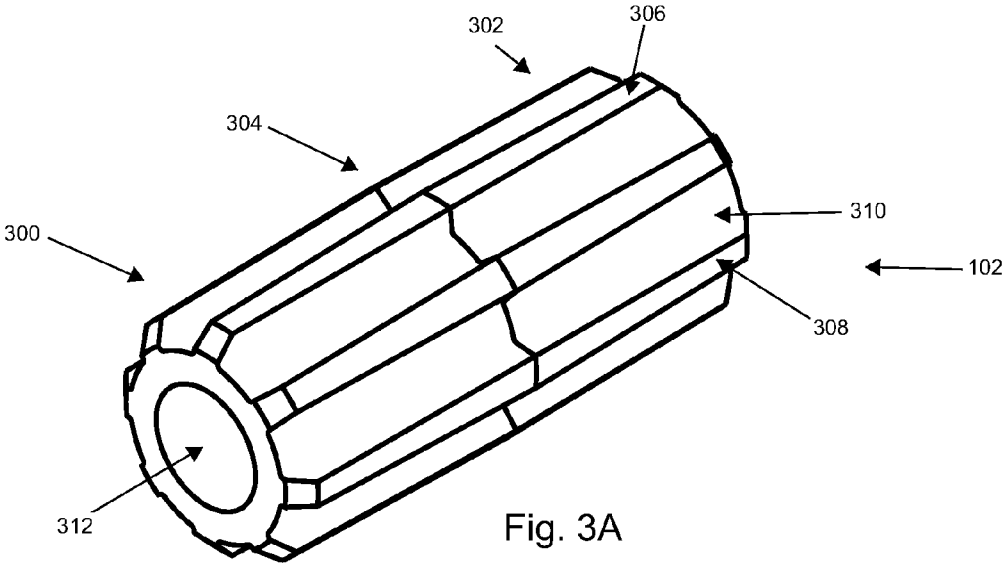
FIG. 3A is a perspective view of an embodiment of the connector.
Figure 4C:
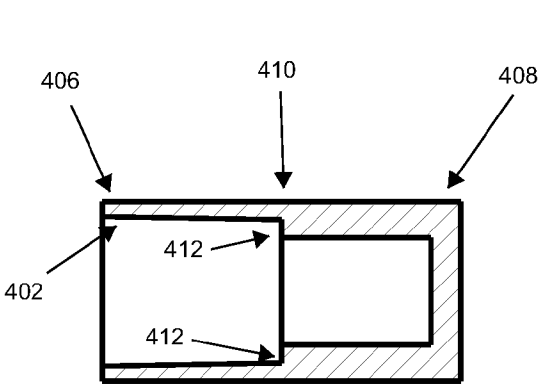
FIG. 4C is cross-sectional side view taken along A-A in FIG. 3B.
Figure 4B:
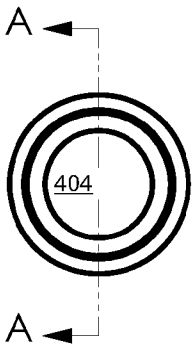
FIG. 4B is a front view of the connectable member shown in FIG. 4A.
Figure 4D:
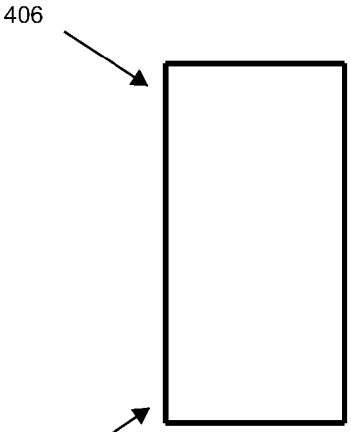
FIG. 4D is a top view of the connectable member shown in FIG. 4A.
Figure 4A:
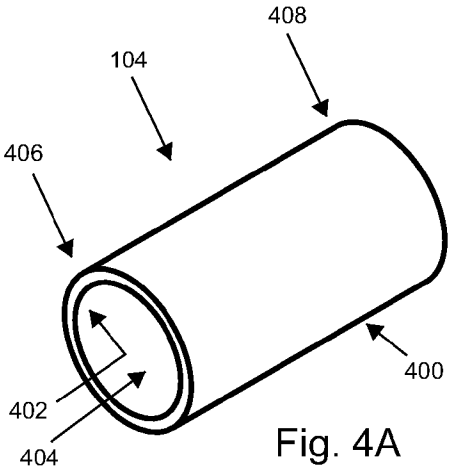
FIG. 4A is a perspective view of an embodiment of a connectable member.
Figure 5C:
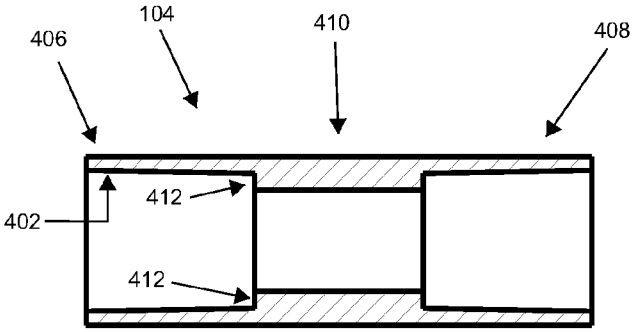
FIG. 5C is cross-sectional side view taken along A-A in FIG. 5B.
Figure 5B:
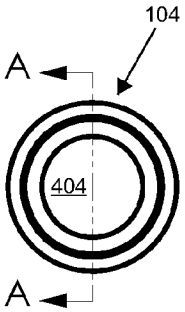
FIG. 5B is a front view of the connectable member shown in FIG. 5A.
Figure 5D:
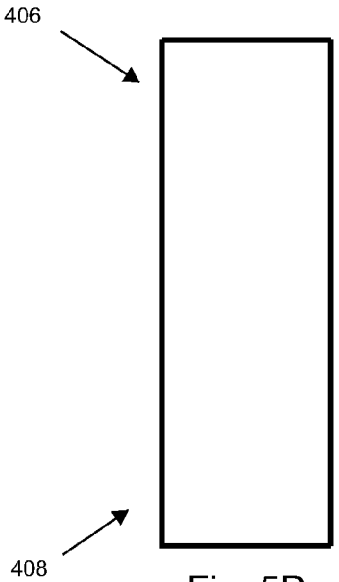
FIG. 5D is a top view of the connectable member shown in FIG. 5A.
Figure 5A:
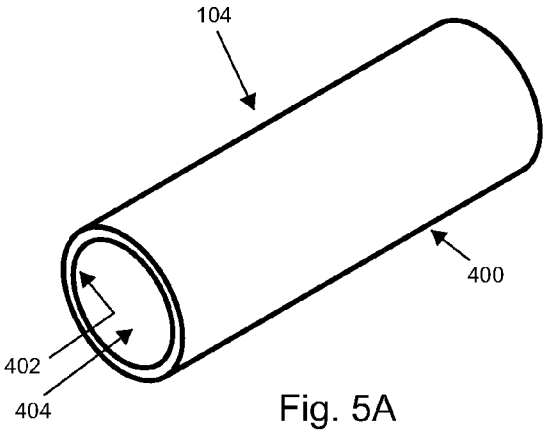
FIG. 5A is a perspective view of another embodiment of a connectable member.

Referring to FIGS. 3A-3C, the connector 102 may be generally an elongated, cylindrical member having a first end 300, a second end 302 opposite the first end 300, a mid-section 304 in between the first and second ends 300, 302, and an outer surface 306 with a shape and dimension that is suitable to tightly fit inside an orifice 404 of the connectable members 104, 105. In some embodiments, the outer surface 306 may taper from the mid-section 304 towards each end 300, 302. The tapering allows the connector 100 to wedge inside, for example, the orifice 404 of the connectable member 104.

In some embodiments, the outer surface 306 the connector 102 may be corrugated with alternating ridges 308 and grooves 310. The corrugation improves the compressibility of the connector 102 when it is wedged inside the orifice 404 of the connectable member 104 or other connecting orifice. In embodiments in which the outer surface 306 of the connector 102 is corrugated, it is the diameter from a first ridge 308*a* to a diametrically opposite ridge 308*b* that is substantially similar to the dimensions of the orifice 404. In some embodiments, the connector 102 may also have a central orifice 312 to improve compressibility.

The connectable members may comprise a generally elongated or tubular appearance (referred to as elongated connectable members 104) or a generally planar or flat appearance (referred to as planar or block connectable members 105). As shown in FIGS. 4A-14D, the elongated or tubular connectable members 104 may come in a variety of styles, configurations, and shapes. For example, the elongated connectable member 104 may come in one dimensional, two dimensional, and three dimensional styles. In the one dimensional style, the elongated connectable member 104 projects along a single dimension or axis. In the two dimensional style, the connectable member 104 projects in a single plain, and therefore, may project along two dimensions or axes. In the three dimensional style, the connectable member 104 projects in at least two planes, and therefore, may project along three dimensions or axes. Preferably, the two planes are perpendicular to each other.

In terms of the configuration, the connectable members 104 may be configured to receive one connector (1-way), two connectors (2-way), three connectors (3-way), four connectors (4-ways), five connectors (5-ways), or six connectors (6-ways). In general, the connecting portion project either parallel or perpendicular to each other so that the structure can grow in a variety of directions: up, down, left, right, forward, back, and any combination thereof. In some embodiments, more connecting portions can be added by projecting at oblique angles, such as diagonal.

In terms of the shape, any geometric shape can be utilized. For example, the elongated-shaped connectable members 104 have shapes that include, but are not limited to, round 104 (FIG. 4A), triangular 107 (FIG. 13A), and rectangular 109 (including square) (FIG. 14A) shapes. The round 104, triangular 107, and rectangular shapes 109 are in reference to the cross-sections of these connectable members as shown in FIGS. 4A-4D, 13A-13D, and 14A-14D, respectively. Therefore, the round connectable member 104 may be an elongated, cylindrical tube having a circular or round cross-section; the triangular connectable member 107 may be an elongated tube having a triangular cross-section; and the rectangular connectable member 109 may be an elongated tube having a rectangular cross-section, where rectangular also includes square shapes.

As shown in FIGS. 4A-4D, each elongated connectable member comprises an outer wall 400 and an inner wall 402 defining a circular void or orifice 404 at a first end 406 of the member 104. The diameter of the circular void 404 is substantially similar to the diameter of the connector 102 so that the connector 102 can be inserted into the circular void 404 and maintain a resistance fit. Preferably, the circular void 404 is slightly smaller than the diameter of the connector 102 so as to create friction between the outer surface 306 of the connector 102 and the inner surface 402 of the connectable member 104 to hold the connector 102 and connectable member 104 together.

In some embodiments, the inner walls 402 may taper radially inward from the first end 406 end of the connectable member 104 to the mid-section 410 so as to decrease the diameter of the circular void 404 from the first end 406 to the mid-section 410. The decreasing diameter increases the frictional forces against a connector 102 as the connector 102 is inserted deeper into the void 404. In some embodiments, the outer wall 306 of the connector 102 may have a reverse taper relative to the void 404, in which the outer wall 306 tapers from the mid-section 304 to the end 300 or 302.

In some embodiments, the circular void 404 may go through the entire member from one end 406 to the opposite end 408 so as to create a hollow tube as shown in FIGS. 5A-5D. In some embodiments, the circular void 404 may only be at the ends 406, 408 so that the middle portion 410 of the tube is solid, thereby providing a structurally stronger member. In some embodiments, the diameter of the circular void 404 may diminish gradually from an end 406, 408 towards the mid-section 410, then diminish abruptly; thereby creating a step 412 as shown in at least FIGS. 4C and 5C. The step 412 can serve as a buttress or stop to prevent the connector 102 from entering into the mid-section 410 or otherwise being inserted completely through the connectable member 104.

Having described the general features of the round connectable members, specific examples are provided in Table 1. Table 1 is a non-exclusive and non-exhaustive list of types of elongated connectable members 104 based on different combination of shapes, styles, and configurations.

TABLE 1

| Shapes | Style | Configuration | FIG. |
|---|---|---|---|
| Round | 1 dimensional | 1-way | 4A-4D |
| Round | 1 dimensional | 2-way | 5A-5D |
| Round | 2 dimensional | 2-way | 6A-6C |
| Round | 2 dimensional | 3-way | 7A-7E |
| Round | 2 dimensional | 4-way | 8A-8E |
| Round | 3 dimensional | 3-way | 9A-9C |
| Round | 3 dimensional | 4-way | 10A-10D |
| Round | 3 dimensional | 5-way | 11A-11E |
| Round | 3 dimensional | 6-way | 12A-12E |
| Triangle | 1 dimensional | 2-way | 13A-13D |
| Rectangle | 1 dimensional | 2-way | 14A-14D |

Figure 6C:
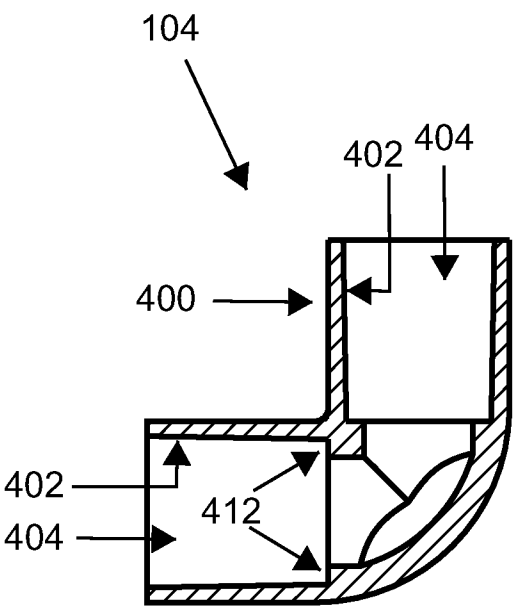
FIG. 6C is a cross-sectional side view taken along A-A in FIG. 6B.
Figure 6B:
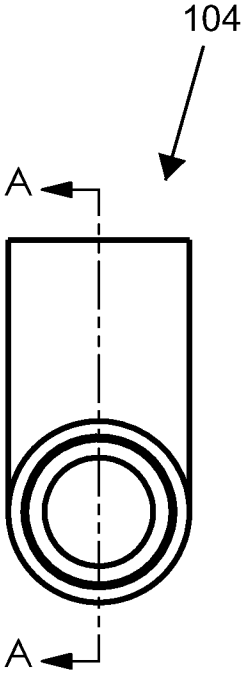
FIG. 6B is a front view of the connectable member shown in FIG. 6A.
Figure 6A:
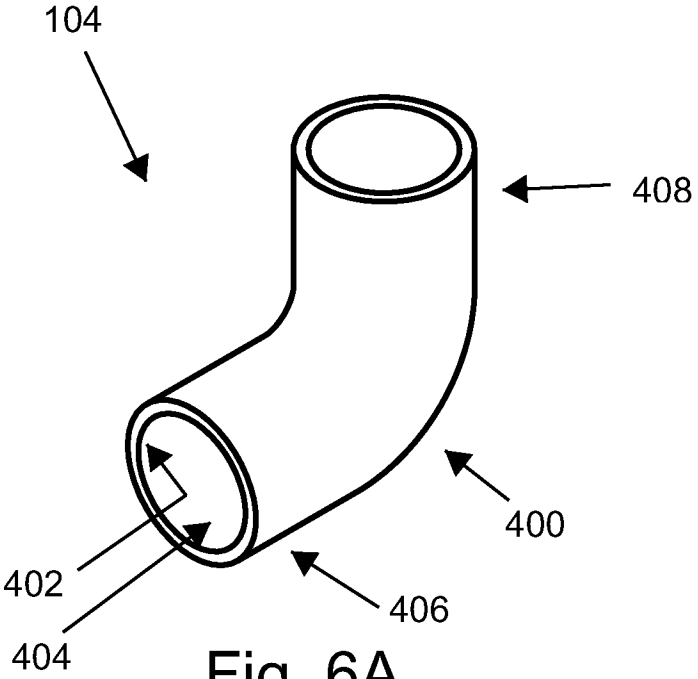
FIG. 6A is a perspective view of another embodiment of a connectable member.
Figure 7A:
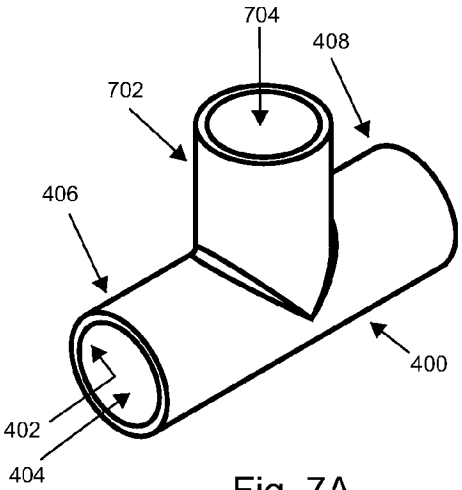
FIG. 7A is a perspective view of another embodiment of a connectable member.
Figure 7B:
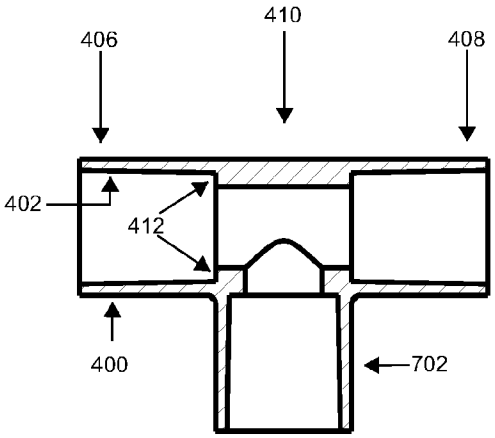
FIG. 7B is cross-sectional side view taken along A-A in FIG. 7C.
Figure 7C:
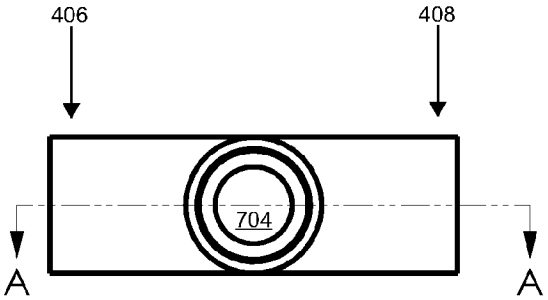
FIG. 7C is a top view of the connectable member shown in FIG. 7A.
Figure 7D:
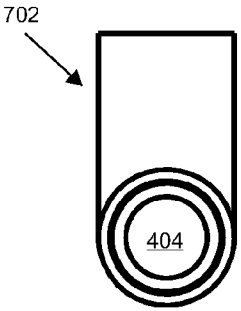
FIG. 7D is a front view of the connectable member shown in FIG. 7A.
Figure 7E:
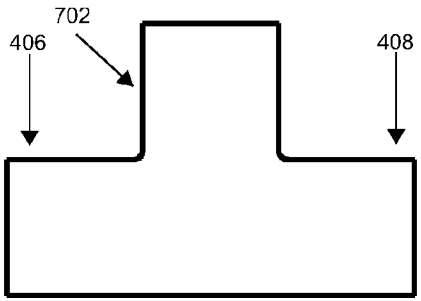
FIG. 7E is a side view of the connectable member shown in FIG. 7A.
Figure 8C:
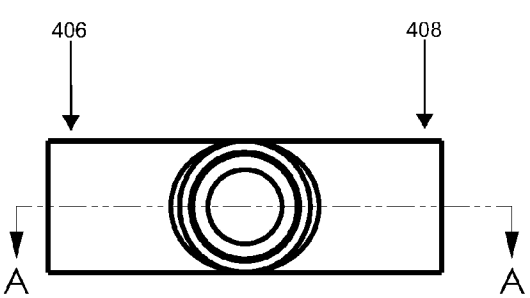
FIG. 8C is a top view of the connectable member shown in FIG. 8A.
Figure 8E:
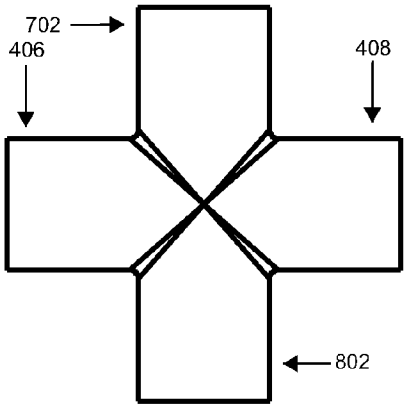
FIG. 8E is a side view of the connectable member shown in FIG. 8A.
Figure 8B:
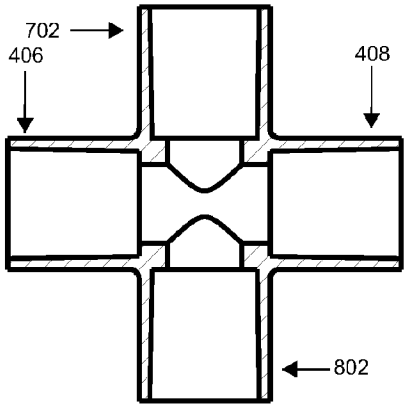
FIG. 8B is cross-sectional side view taken along A-A in FIG. 8C.
Figure 8D:
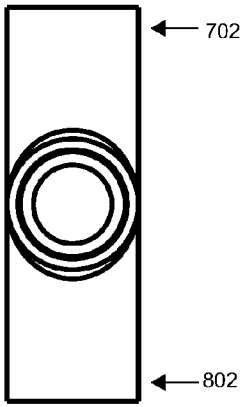
FIG. 8D is a front view of the connectable member shown in FIG. 8A.
Figure 8A:
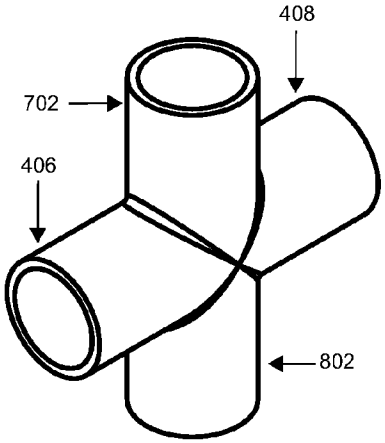
FIG. 8A is a perspective view of another embodiment of a connectable member.

Therefore, a two-dimensional style, two-way connectable member may be in the shape of an elbow as shown in FIGS. 6A-6C. A two-dimensional, three-way connectable member may have a third end 702 protruding perpendicularly away from the mid-section 410 as shown in FIGS. 7A-7E. The third end 702 may have another orifice 704 into which a connector 102 can be inserted. A two-dimensional, four-way connectable member adds a fourth end 802 projecting perpendicularly away from the mid-section 410, opposite the third end 702. The fourth end 802 may have another orifice 804. Additional ends can be added at oblique angles to increase the number of connectable ends, while maintain a two-dimensional style.

Figure 9C:
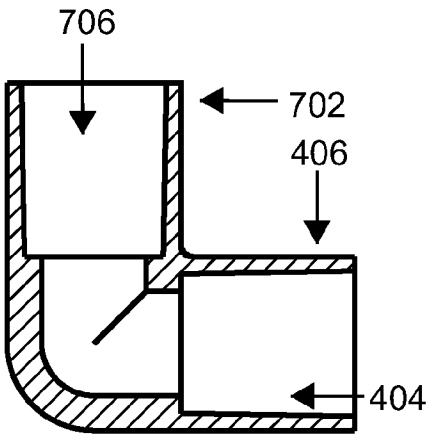
FIG. 9C is cross-sectional side view taken along A-A in FIG. 9C.
Figure 9B:
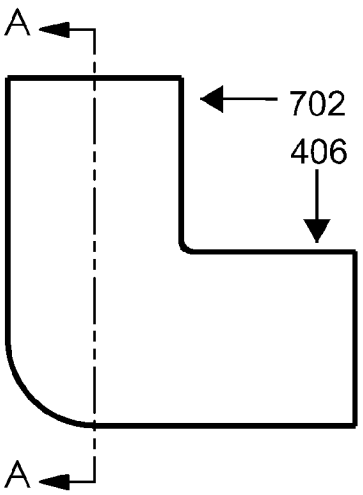
FIG. 9*b* is a side view of the connectable member shown in FIG. 9A.
Figure 9A:
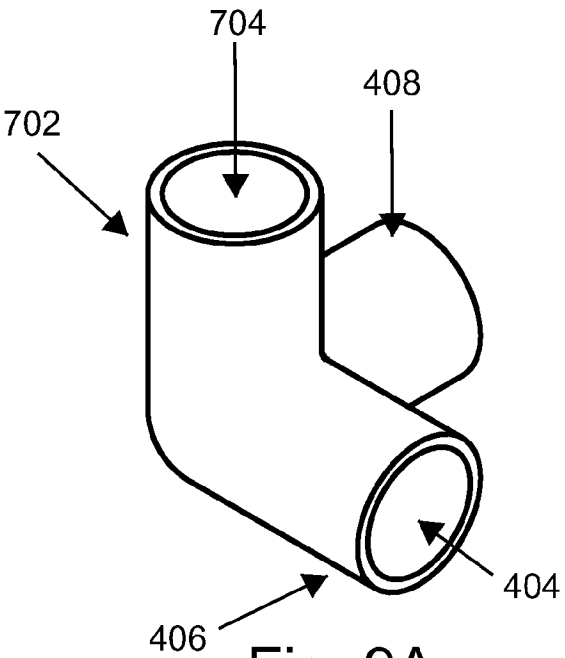
FIG. 9A is a perspective view of another embodiment of a connectable member.
Figure 10B:
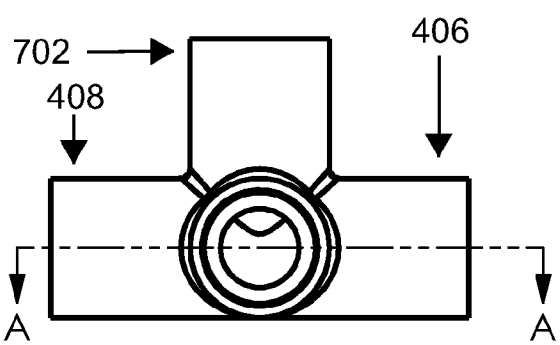
FIG. 10B is a top view of the connectable member shown in FIG. 10A.
Figure 10D:
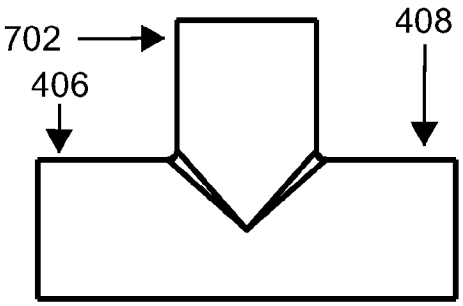
FIG. 10D is a side view of the connectable member shown in FIG. 10A.
Figure 10C:
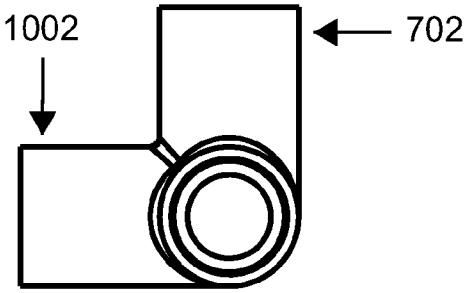
FIG. 10C is a front view of the connectable member shown in FIG. 10A.
Figure 10A:
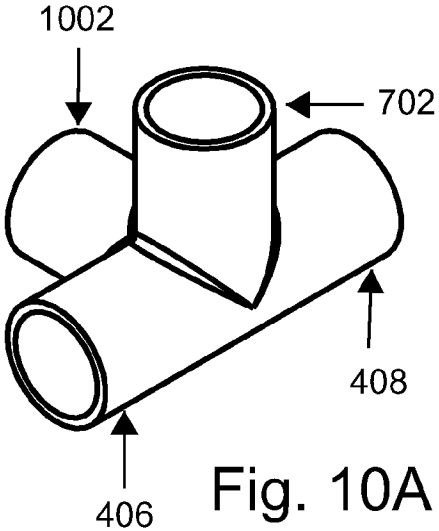
FIG. 10A is a perspective view of another embodiment of a connectable member.
Figure 11A:
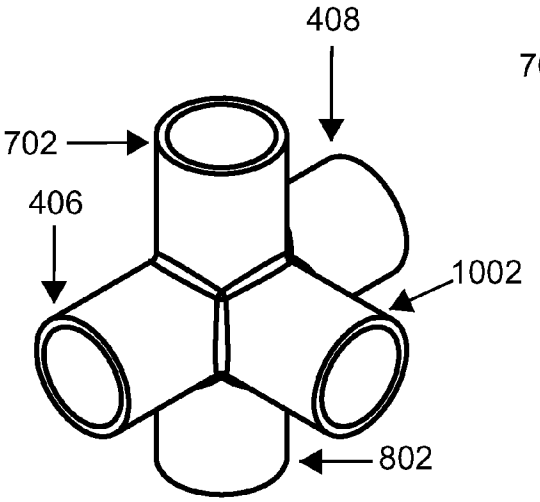
FIG. 11A is a perspective view of another embodiment of a connectable member.
Figure 11B:
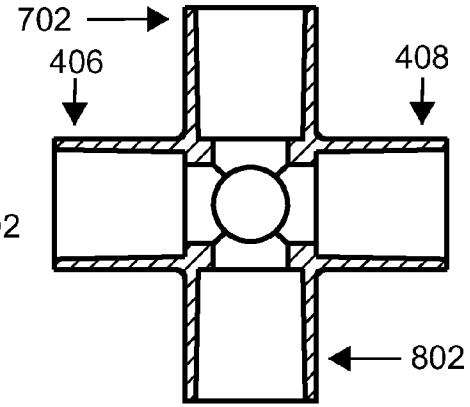
FIG. 11B is cross-sectional side view taken along A-A in FIG. 11C.
Figure 11C:
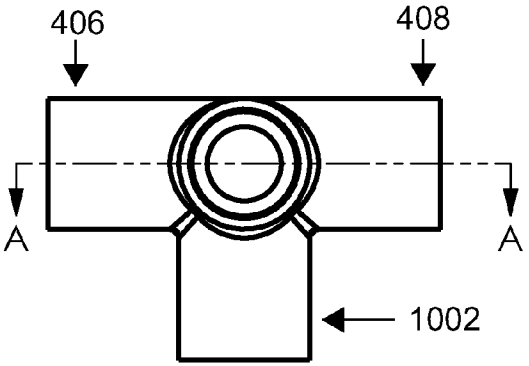
FIG. 11C is a top view of the connectable member shown in FIG. 11A.
Figure 11D:
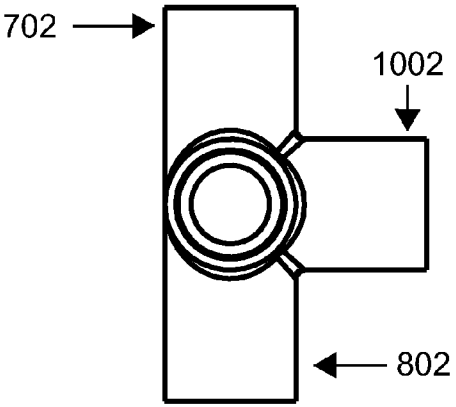
FIG. 11D is a side view of the connectable member shown in FIG. 11A.
Figure 11E:
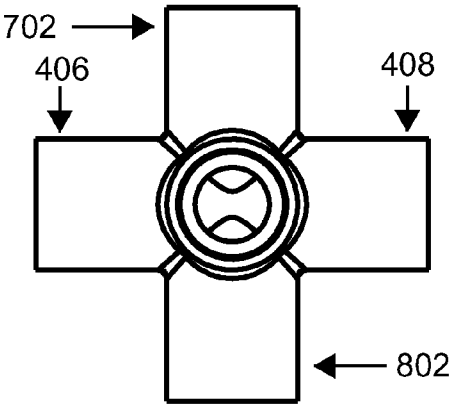
FIG. 11E is a front view of the connectable member shown in FIG. 11A.
Figure 12A:
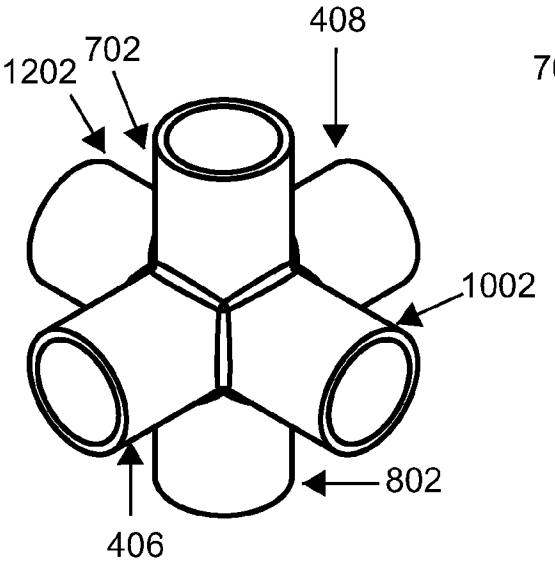
FIG. 12A is a perspective view of another embodiment of a connectable member.
Figure 12B:
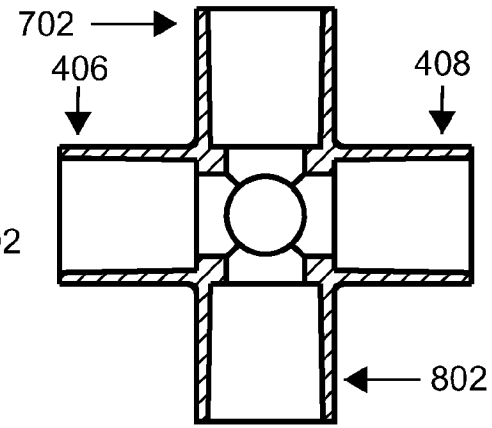
FIG. 12B is cross-sectional side view taken along A-A in FIG. 12C.
Figure 12C:
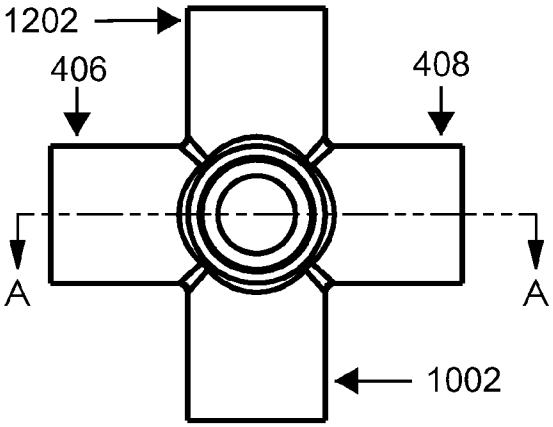
FIG. 12C is a top view of the connectable member shown in FIG. 12A.
Figure 12D:
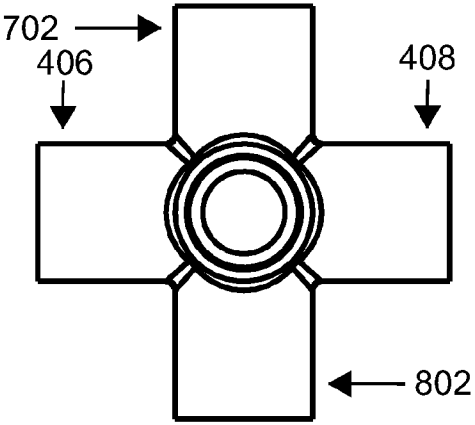
FIG. 12D is a front view of the connectable member shown in FIG. 12A.
Figure 12E:
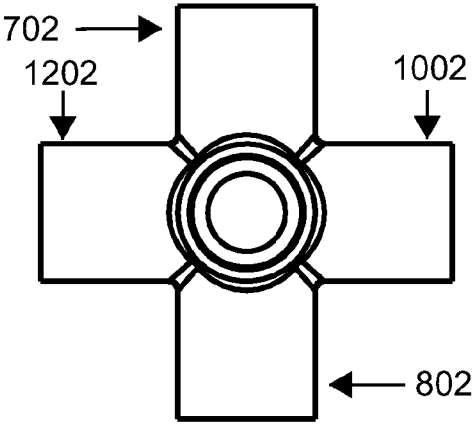
FIG. 12E is a side view of the connectable member shown in FIG. 12A.

Three-dimensional styles having three-way connectable ends have three projecting ends 406, 408, 702 all perpendicular to each other as shown in FIGS. 9A-9B. Each projecting end 406, 408, 702 can have an orifice. For three-dimensional styles having four-, five-, and six-way connectable ends, an additional projecting end 802, 1002, 1202 can be added perpendicular to at least one of the pre-existing ends. Each projecting end can have an orifice into which the connector 102 can fit.

As shown in FIGS. 15A-15D the block connectable member 105 comprises generally a flat rectangular or square shaped platform 1502 having at least two bilateral extensions 1504, 1506 projecting perpendicularly therefrom. The extensions 1504, 1506 may be connected to a second platform 1508 that is parallel to the first platform 1502 and perpendicular to the extensions 1504, 1506, thereby forming a generally block shape. In some embodiments, the first and/or the second platforms 1502, 1508 may be removably connected to the extensions 1504, 1506, preferably as a snap-fit or some other type of resistance fit for quick assembly and disassembly.

In some embodiments, the platforms 1502, 1508 may have a central orifice 1510. This central orifice 1510 may be circular, triangular, rectangular, star, heart, or the like, so as to be configured to receive a connector 102, a round connectable member 104, a triangular connectable member 107, a square connectable member 109, a star connectable member, a heart-shaped connectable member, and the like. Any other shape may be utilized for the shape of the central orifice 1510, the shape of the connectable members 104, and the shape of the connectors 102, so long as shapes are configured so that the connectors 102 and/or connectable members 104 can fit tightly inside the orifice 1510.

In some embodiments, the edge 1512 defining the central orifice 1510 may further comprise at least one protuberance projecting radially inward. Preferably, the edge 1512 defining the central orifice 1510 comprises a plurality of protuberances, each protuberance projecting radially inward and each protuberance angularly spaced apart from each other around the edge 1512. These protuberances can prevent rotational movement of a connectable member 104 or connector 102 inserted inside the central orifice 1510. In embodiments in which the edge 1512 defining the central orifice 1510 comprises protuberances angularly spaced apart along the perimeter of the central orifice 1510, the grooves 310 of the connector 102 can be configured to have the protuberances of the edge 1512 fit inside the grooves 310 when the connector 102 is inserted into the central orifice 1510. This improves the connection between the connector 102 and the block connectable member 105 and prevents rotation of the connector 102 if this is so desired.

Figures 15A, 15B, 15C, 15D:
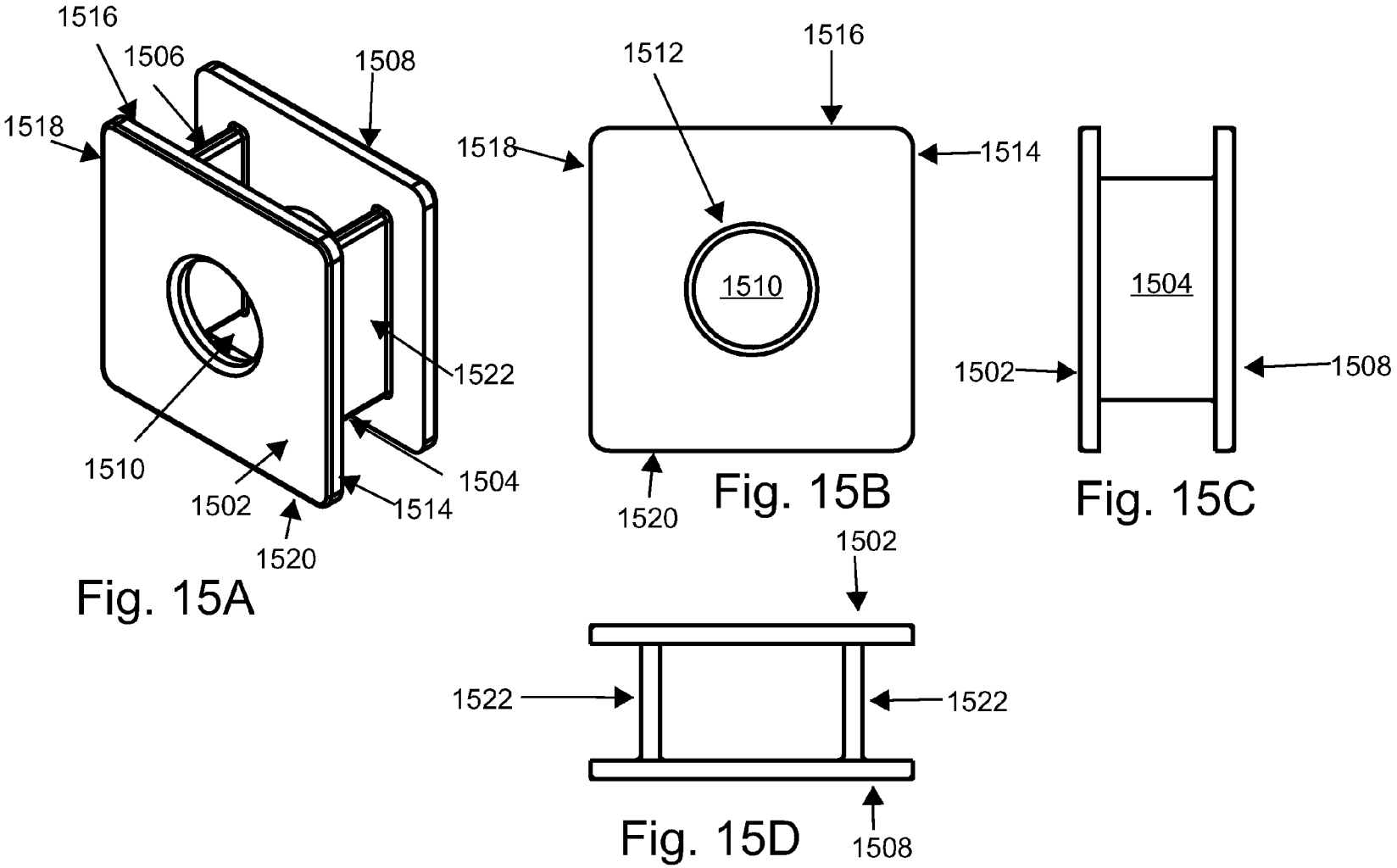
FIG. 15A is a perspective view of another embodiment of a connectable member.
FIG. 15B is a front view of the connectable member shown in FIG. 15A.
FIG. 15C is a side view of the connectable member shown in FIG. 15A.
FIG. 15D is a top view of the connectable member shown in FIG. 15A.
Figure 15G:
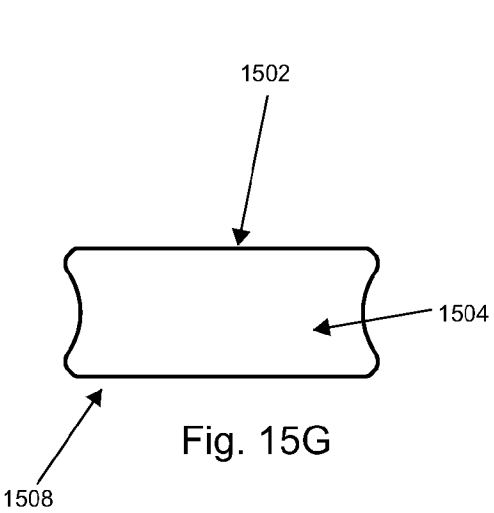
FIG. 15G is a side view of the connectable member shown in FIG. 15E.
Figure 15F:
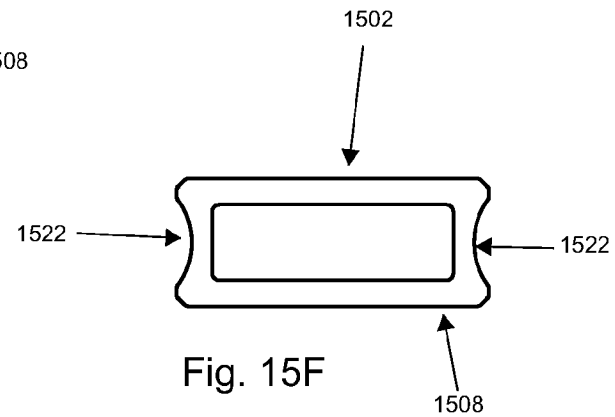
FIG. 15F is a front view of the connectable member shown in FIG. 15E.
Figure 15I:
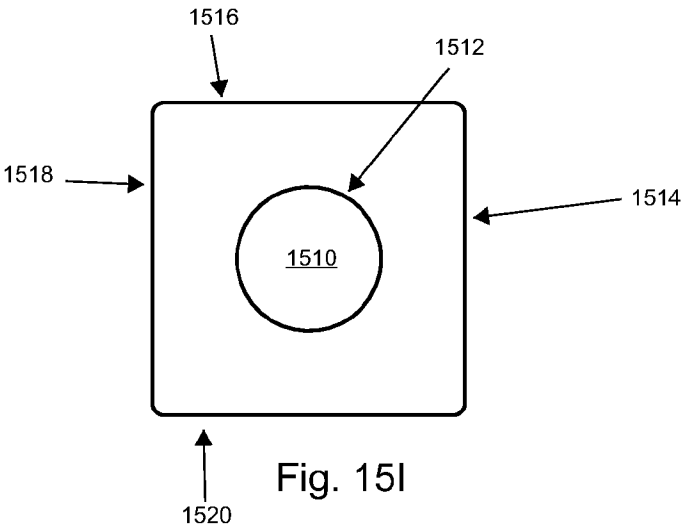
FIG. 15I is a top view of the connectable member shown in FIG. 15E.
Figure 15E:
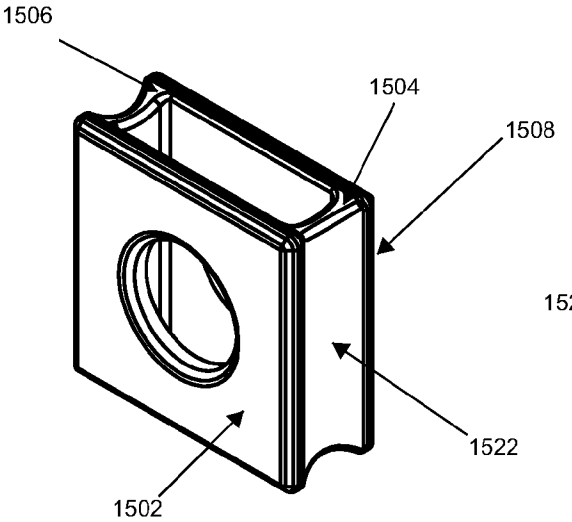
FIG. 15E is a perspective view of another embodiment of a connectable member.
Figure 15H:
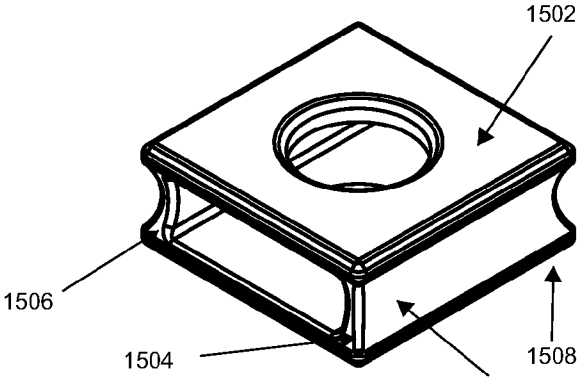
FIG. 15H is another perspective view of the connectable member shown in FIG. 15E.
Figure 16C:
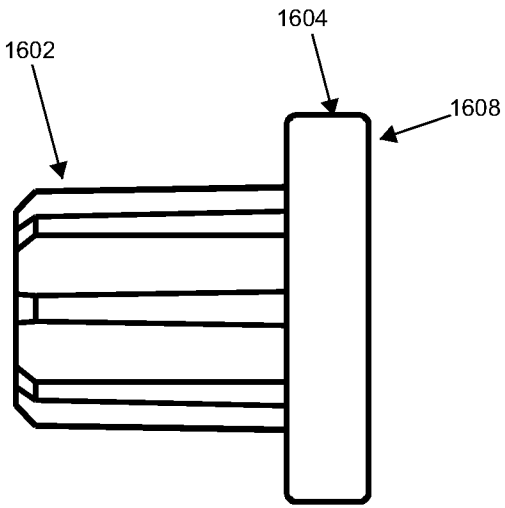
FIG. 16C is a side view of the end cap shown in FIG. 16A.
Figure 16B:
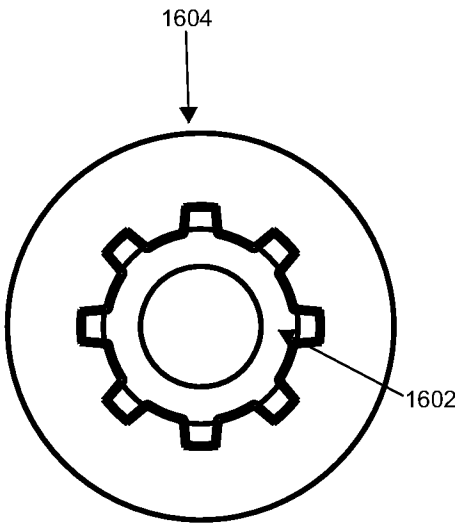
FIG. 16B is a front view of the end cap shown in FIG. 16A.
Figure 16A:
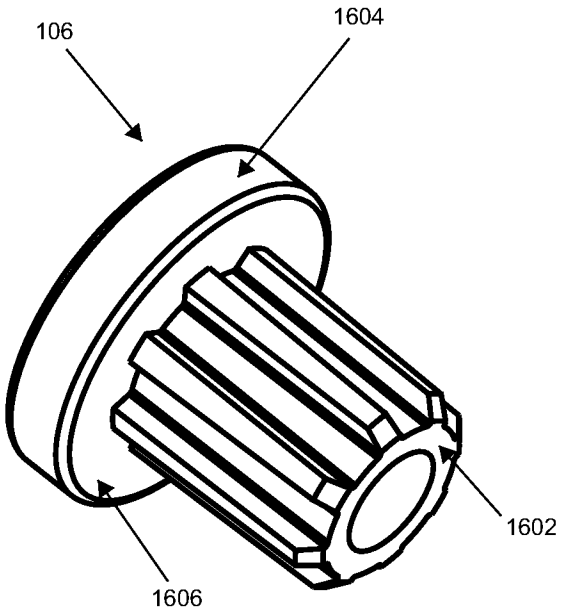
FIG. 16A is a perspective view of an embodiment of an end cap.

The distance between the first and second platforms 1502, 1508 created by the extensions 1504, 1506 is substantially similar to the diameter of the outer surface 400 of a round connectable member 104. In some embodiments, the diameter of the outer surface 400 may be slightly larger or slightly smaller than the distance between the first and second platforms 1502, 1504. In addition, the extensions 1504, 1506 may be positioned medially inward from the edges 1514, 1516, 1518, 1520 of the platforms 1502, 1508 so as to create a recess into which the round connectable members 104 can fit or be seated in a longitudinal orientation as shown in FIG. 15D.

In some embodiments, the extensions 1504, 1506 may be curved as shown in FIGS. 15E-15H. Specifically, the outer surface 1522 of the extensions 1504, 1506 may be concave in a manner that conforms to the curvature of the outer surface 400 of one of the round-type, elongated connectable member 104 shown in FIGS. 4A-12E.

Figure 17C:
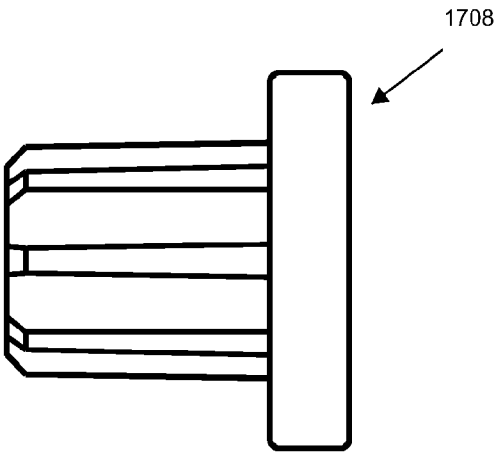
FIG. 17C is a side view of the end cap shown in FIG. 17A.
Figure 17B:
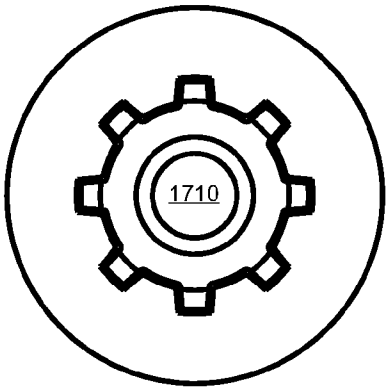
FIG. 17B is a front view of the end cap shown in FIG. 17A.
Figure 17A:
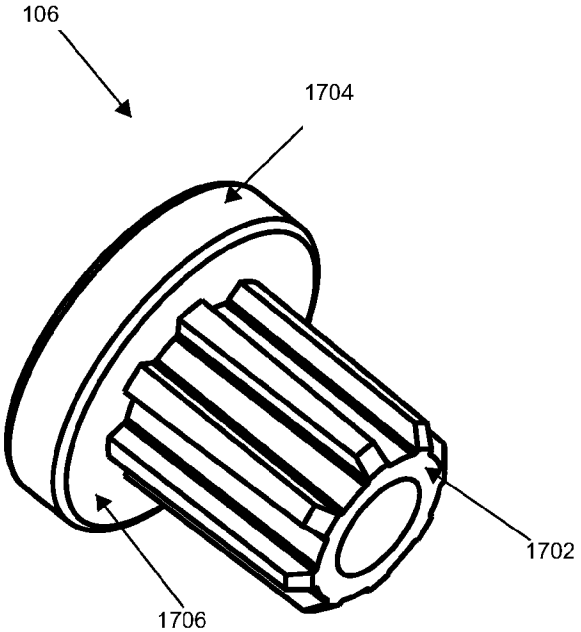
FIG. 17A is a perspective view of another embodiment of an end cap.
Figure 18C:
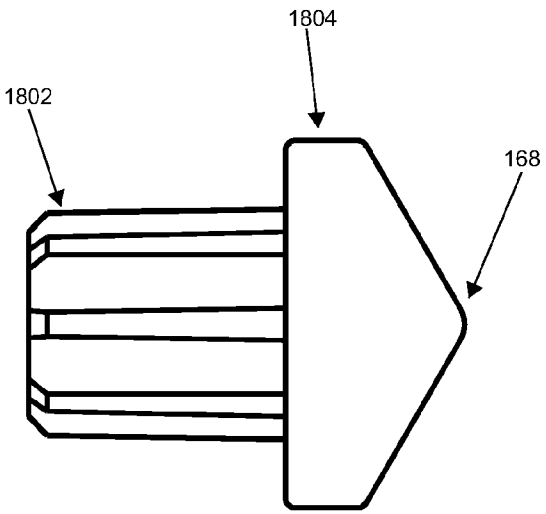
FIG. 18C is a side view of the end cap shown in FIG. 18A.
Figure 18B:
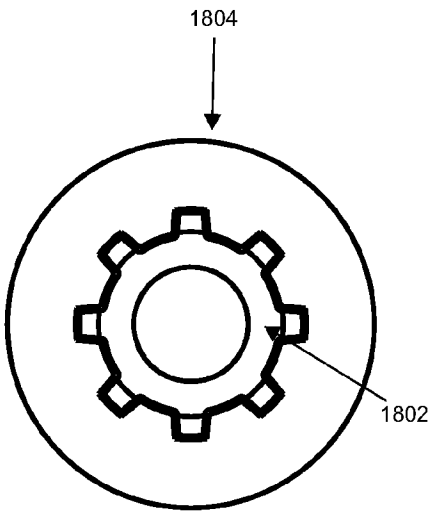
FIG. 18B is a front view of the end cap shown in FIG. 18A.
Figure 18A:
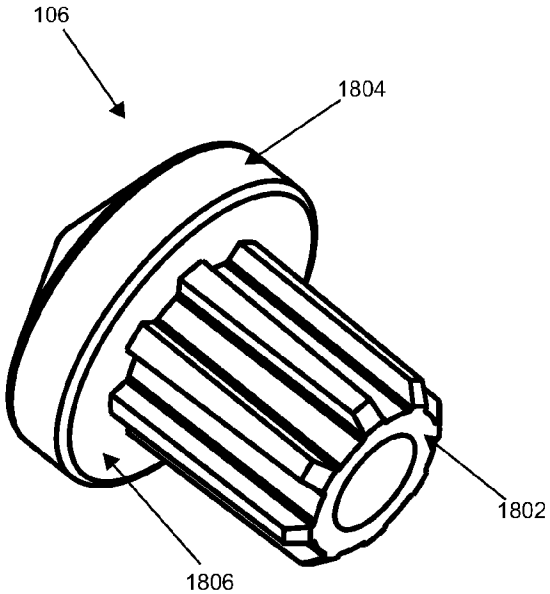
FIG. 18A is a perspective view of another embodiment of an end cap.

The toy connector system may further comprise a variety of other accessory parts. Other accessory parts include end caps 106, wheels 110, gaskets or O-rings 112, and bars 114. As shown in FIGS. 16A-18C, end caps 106 comprise a connector portion 1602 attached perpendicularly to a disk-like top 1604 at a first surface 1606. A second surface 1608 of the top 1604, opposite the first surface 1606, may be flat. Alternatively, the second surface 1608 may be pointed, dome-shaped, conical, and the like as shown in FIG. 18C. In some embodiments, the top 1604 may have a central orifice 1710 as shown in FIG. 17B. End caps 106 can be used to cover any central orifice 404 of a connectable member that is not associated with a connector 102 so that the overall structure is aesthetically pleasing to the user.

Wheels 110 can be used to build structures requiring wheels. The wheel 110 can have a central orifice to slide the wheel 110 onto a connectable member 104 or a connector 102. A pair of gaskets or o-rings 112 can be used to secure the wheel 110 on to the connectable member 104 by sandwiching the wheel 110 on opposite sides with the gasket 112.

Bars 114 can come in a variety of shapes and sizes, to function as frame-work, anti-roll bars, support bars, bumpers, and numerous of functions. For example, the bar 114 may be a rectangular bar, a dome-shaped or curved bar, a triangular bar, a U-bar (shaped like a "U"), a V-bar or angle (shaped like a "V") and the like. At least one of the ends of each bar 114 may have an orifice so as to be connectable to a connector 102.

Figure 19:
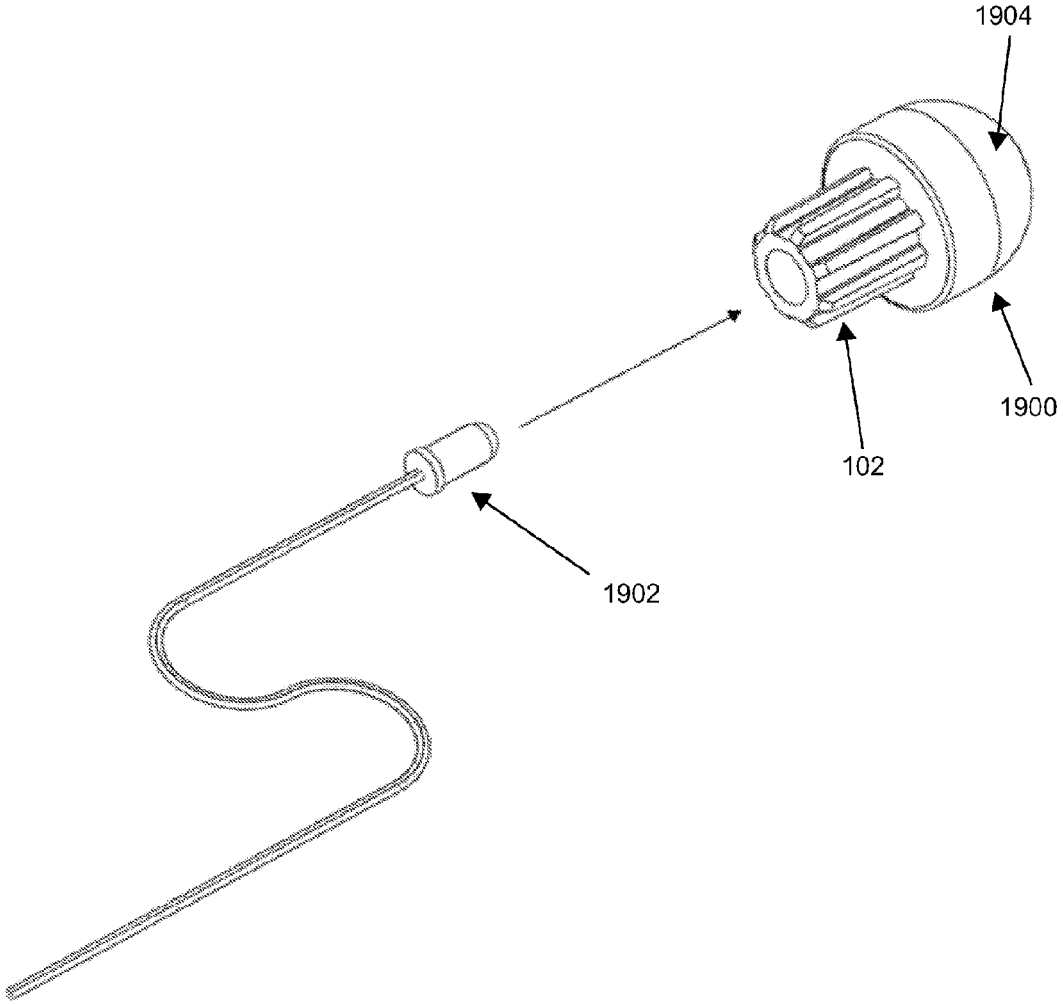
FIG. 19 is a perspective view of an embodiment of a light.

As shown in FIG. 19, light bulbs 1900 may be used to provide lighting. Preferably, light emitting diodes (LED) 1902 may be used to provide the light source. An LED 1902 may be inserted into the light bulb 1900. The light bulb 1900 may comprise a transparent or translucent portion 1904 attached to a connector 102. Thus, the light bulb 1900 may be may be connectable to other pieces via the connector 102.

As shown in FIGS. 20A-20G, a door 2000 may also be provided to close a variety of different types of openings. The door 2000 may be secured through a type of resistance fit mechanism. For example, the door 2000 may comprise two protruding walls 2004, 2006. The walls 2004, 2006 may be concave to conform to the cylindrical shape of a connectable member 104 so as to snap onto the connectable member.

Figure 20C:
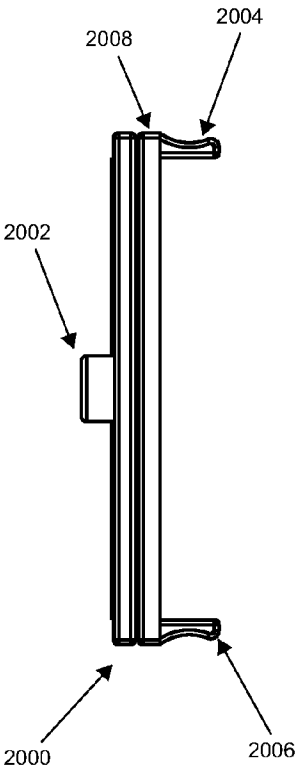
FIG. 20C is a side view of the door shown in FIG. 20A.
Figure 20B:
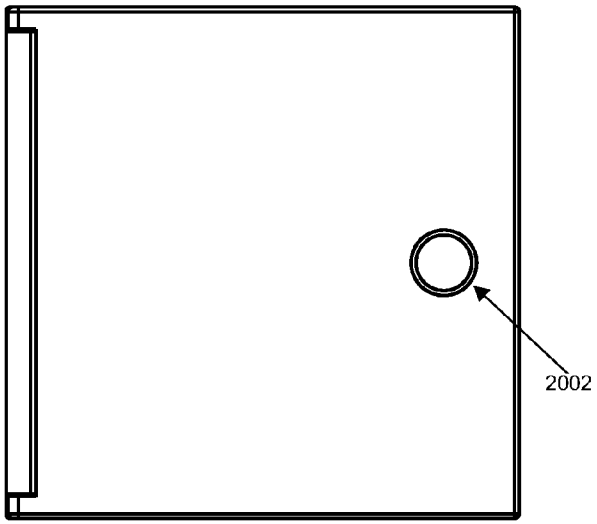
FIG. 20B is a front view of the door shown in FIG. 20A
Figure 20A:
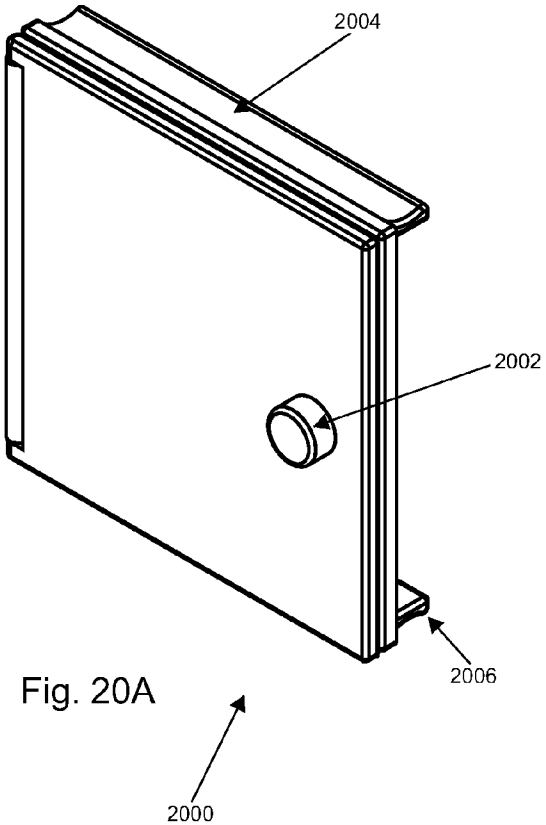
FIG. 20A is a perspective view of an embodiment of a door.
Figure 20F:
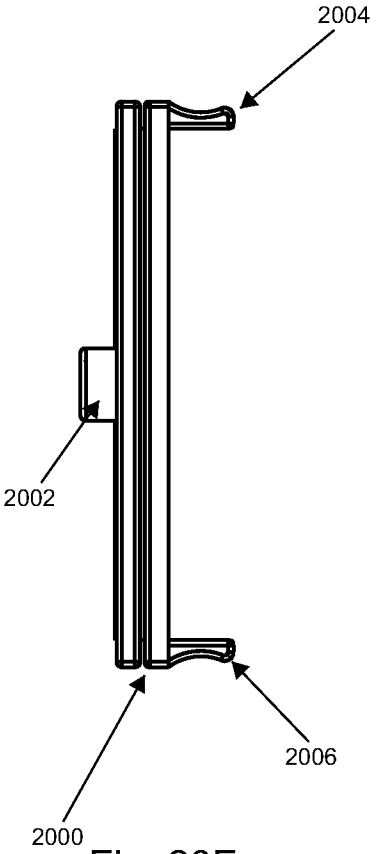
FIG. 20F is a side view of the door shown in FIG. 20D.
Figure 20E:
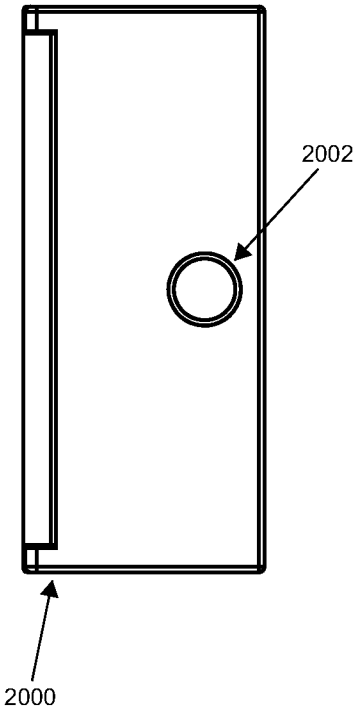
FIG. 20E is a front view of the door shown in FIG. 20D.
Figure 20D:
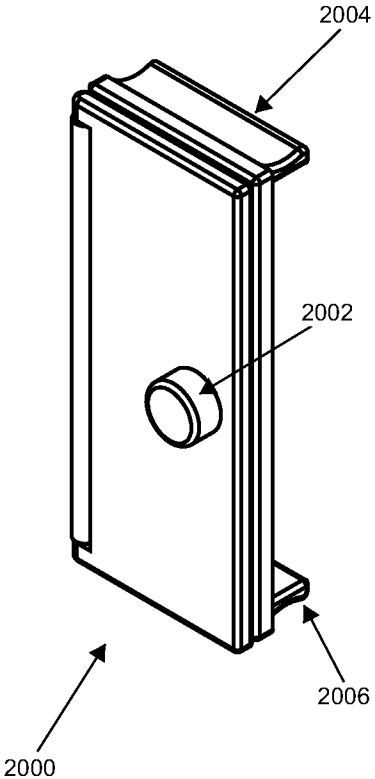
FIG. 20D is a perspective view of another embodiment of a door.
Figure 20G:
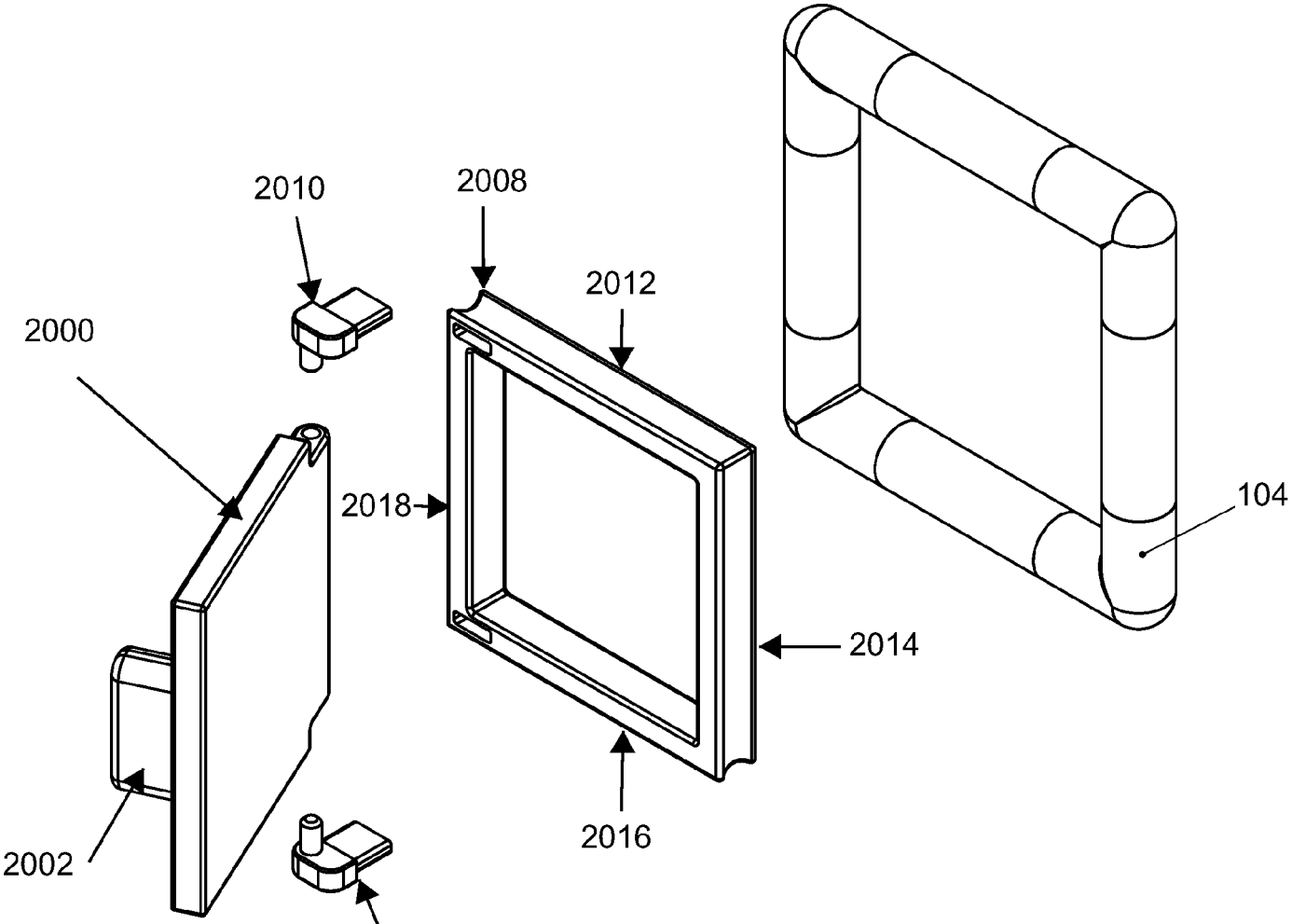
FIG. 20G is an exploded view of a door accessory.

In some embodiments, the door 2000 may be secured via hinges 2010 and other types of connections that allow the door to swing open and closed. The door 2000 may be hingedly attached to a frame 2008. The frame 2008 may have arms 2012, 2014, 2016, 2018 having outer surfaces that concave inward to receive connectable members 104 as shown in FIG. 20G. The frame 2008 is secured to a connectable member 104 while the door 2000 can swing open and closed on the frame 2008. The door can be square, rectangular, or any other shape that is substantially similar to any opening it is intended to close. The door 2000 may further comprise a knob 2002.

The parts can be made from a variety of relatively rigid material, such as wood, plastic, rubber, foam, and the like. Sturdy, but compressible material, is particularly helpful to connect pieces.

In use, a user can insert one end of a connector 102 into a first connectable member 104 and insert the other end of the connector 102 either to another connectable member 104 or an accessory member and continue this process until the user creates a model structure, such as a transportation vehicle, building, animal, or the like.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed:

1. A toy connector system, comprising:

a. a plurality of connectors;

b. a plurality of connectable members comprising elongated connectable members, and planar connectable members, wherein at least one of the plurality of connectors is configured to join at least a first connectable member to a second connectable member to build a structure, c. wherein each connector is an elongated, cylindrical member having a first end, a second end opposite the first end, a mid-section in between the first and second ends, and an outer surface defining a connector diameter;

d. wherein each elongated connectable member comprises a first end, a second end opposite the first end, a mid-section in between the first and second ends, an outer wall, and an inner wall defining a circular void at at least the first end of the elongated connectable member, wherein a circular void diameter is substantially equal to the connector diameter so as to create a resistance fit between the elongated connectable member and the connector, and e. wherein each planar connectable member comprises a first flat platform defined in a first plane, the first flat platform defined by a first edge, a second edge opposite and parallel to the first edge, a third edge perpendicular to and connecting the first and second edges, and a fourth edge opposite and parallel to the third edge and perpendicular and connected to the first and second edges, the first flat platform having at least two bilateral extensions, a first extension having a solid wall projecting perpendicularly from the first plane and adjacent to and along the first edge, and a second extension having a solid wall projecting perpendicularly from the first plane and adjacent to and along the second edge.

2. The toy connector of claim 1, wherein the outer surface of the connector tapers from the mid-section towards each end.

3. The toy connector of claim 1, wherein the outer surface of the connector is corrugated with alternating ridges and grooves.

4. The toy connector of claim 1, wherein the connector comprises a central orifice.

5. The toy connector of claim 1, wherein the inner wall of the elongated connectable member tapers radially inward from the first end of the connectable member towards the mid-section so as to decrease the diameter of the circular void from the first end towards the mid-section.

6. The toy connector of claim 1, wherein the elongated connectable members comprise a stop within the circular void.

7. The toy connector of claim 1, wherein a first elongated connectable member has a circular cross-section, a second elongated member has a triangular cross-section, and a third elongated member has a rectangular cross-section wherein each of the first, second, and third elongated members has a central void.

8. The toy connector of claim 1, wherein at least one elongated connectable member is configured to have a six-way connection.

9. The toy connector of claim 1, wherein the first flat platform comprises a central orifice equidistant from the first edge, the second edge, the third edge, and the fourth edge.

10. The toy connector of claim 1, wherein the planar connectable member further comprises a second flat platform, parallel to the first gene flat platform, wherein the second flat platform is attached to the bilateral extensions to created a box-like configuration, wherein the first flat platform and the second flat platform define a gap that is similar to a diameter of an outer surface of a round connectable member.

11. The toy connector of claim 10, wherein the bilateral extensions are positioned medially inward from the edges of the first flat platform so as to create the gap into which the round connectable member can be seated in a longitudinal orientation.

12. The toy connector of claim 10, wherein the bilateral extensions are curved inward.

13. The toy connector system of claim 1, further comprising a light source.

14. The toy connector system of claim 13, further comprising an end cap having a connector portion attached perpendicularly to a disk-like top at a first surface.

15. The toy connector system of claim 14, wherein at least one end cap comprises a second surface opposite the first surface, wherein the second surface is dome-shaped.

16. A toy connector kit, comprising:

a. a plurality of connectors;

b. a plurality of connectable members comprising elongated connectable members, and planar connectable members, wherein at least one of the plurality of connectors is configured to join at least a first connectable member to a second connectable member to build a structure; and c. a plurality of end caps attachable to the connectable members, each end cap having a connector portion attached perpendicularly to a disk-like top at a first surface, d. wherein each connector is an elongated, cylindrical member having a first end, a second end opposite the first end, a mid-section in between the first and second ends, and an outer surface defining a connector diameter, wherein the outer surface of the connector tapers from the mid-section towards each end, wherein the outer surface of the connector is corrugated with alternating ridges and grooves, wherein the connector comprises a central orifice;

e. wherein each elongated connectable member comprises a first end, a second end opposite the first end, a mid-section in between the first and seconds ends, an outer wall, and an inner wall defining a circular void at at least the first end of the elongated connectable member, the circular void having a circular void diameter that is substantially equal to the connector diameter so as to create a resistance fit between the elongated connectable member and the connector, wherein each elongated connectable member comprises a stop within the circular void, wherein at least a first elongated connectable member is a round connectable member having a circular cross-section, wherein at least a second elongated member is a triangular connectable member having a triangular cross-section, wherein at least a third elongated member is a rectangular connectable member having a rectangular cross-section, f. wherein each planar connectable member comprises a first flat platform defined in a first plane, the first flat platform defined by a first edge, a second edge opposite and parallel to the first edge, a third edge perpendicular to and connecting the first and second edges, and a fourth edge opposite and parallel to the third edge and perpendicular and connected to the first and second edge, the first flat platform having at least two bilateral extensions, a first extension having a first solid wall projecting perpendicularly from the first plane and adjacent to and extending along the first edge, and a second extension having a second solid wall projecting perpendicularly from the first plane and adjacent to and along the second edge, and a second flat platform, parallel to the first flat platform, wherein the second flat platform is attached to the bilateral extensions to create a box-like configuration, wherein the first flat platform and the second flat platform define a gap that is similar to a diameter of an outer surface of a round connectable member, wherein the bilateral extensions are positioned medially inward from the edges of the first flat platform so as to create the gap into which the round connectable member can be seated in a longitudinal orientation, and g. wherein at least one of the plurality of connectable members comprises a central opening equidistant from the first edge, the second edge, the third edge, and the fourth edge.

17. The toy connector kit of claim 16, wherein the inner wall of the elongated connectable member tapers radially inward from the first end of the connectable member towards the mid-section so as to decrease the diameter of the circular void from the first end towards the mid-section.

18. The toy connector kit of claim 16, wherein at least one end cap comprises a second surface opposite the first surface, wherein the second surface is dome-shaped.

19. A toy connector kit, comprising:

a. a plurality of connectors;

b. a plurality of connectable members comprising elongated connectable members, and planar connectable members, wherein at least one of the plurality of connectors is configured to join at least a first connectable member to a second connectable member to build a structure; and c. a plurality of end caps attachable to the connectable members, each end cap having a connector portion attached perpendicularly to a disk-like top at a first surface, d. wherein each connector is an elongated, cylindrical member having a first end, a second end opposite the first end, a mid-section in between the first and second ends, and an outer surface defining a connector diameter, wherein the outer surface of the connector tapers from the mid-section towards each end, wherein the outer surface of the connector is corrugated with alternating ridges and grooves, wherein the connector comprises a central orifice;

e. wherein each elongated connectable member comprises a first end, a second end opposite the first end, a mid-section in between the first and seconds ends, an outer wall, and an inner wall defining a circular void at at least the first end of the elongated connectable member, the circular void having a circular void diameter that is substantially equal to the connector diameter so as to create a resistance fit between the elongated connectable member and the connector, wherein each elongated connectable member comprises a stop within the circular void, wherein at least a first elongated connectable member is a round connectable member having a circular cross-section, wherein at least a second elongated member is a triangular connectable member having a triangular cross-section, wherein at least a third elongated member is a rectangular connectable member having a rectangular cross-section, f. wherein each planar connectable member comprises a first flat platform defined in a first plane, the first flat platform defined by a first edge, a second edge opposite and parallel to the first edge, a third edge perpendicular to and connecting the first and second edges, and a fourth edge opposite and parallel to the third edge and perpendicular and connected to the first and second edge, the first flat platform having at least two bilateral extensions, a first extension having a first solid wall projecting perpendicularly from the first plane and adjacent to and extending along the first edge, and a second extension having a second solid wall projecting perpendicularly from the first plane and adjacent to and along the second edge, and a second flat platform, parallel to the first flat platform, wherein the second flat platform is attached to the bilateral extensions to create a box-like configuration, wherein the bilateral extensions are curved inward so as to create a space into which the round connectable member can be seated in a longitudinal orientation, and g. wherein at least one of the plurality of connectable members comprises a central opening equidistant from the first edge, the second edge, the third edge, and the fourth edge.

20. The toy connector kit of claim 19, wherein the inner wall of the elongated connectable member tapers radially inward from the first end of the connectable member towards the mid-section so as to decrease the diameter of the circular void from the first end towards the mid-section.

* * * * *